US006648466B2

(12) United States Patent
Beauchamp et al.

(10) Patent No.: US 6,648,466 B2
(45) Date of Patent: Nov. 18, 2003

(54) INKJET PRINTER INCLUDING FIXED PRINTHEADS AND TRANSFER ROLLER

(75) Inventors: Robert W. Beauchamp, Carlsbad, CA (US); Eric Joseph Johnson, San Diego, CA (US)

(73) Assignee: Hewlett Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/739,555

(22) Filed: Dec. 15, 2000

(65) Prior Publication Data

US 2001/0040615 A1 Nov. 15, 2001

Related U.S. Application Data

(63) Continuation-in-part of application No. 09/571,647, filed on May 15, 2000.

(51) Int. Cl.[7] ..... B41J 2/01
(52) U.S. Cl. ..... 347/103
(58) Field of Search ..... 347/103, 153, 347/101, 20; 399/297, 279

(56) References Cited

U.S. PATENT DOCUMENTS 5,274,428 A * 12/1993 Wong et al.
6,386,697 B1 * 5/2002 Yamamoto et al. ..... 347/103
6,392,681 B1 * 5/2002 Wood et al. ..... 347/218

* cited by examiner

*Primary Examiner*—Raquel Yvette Gordon

(57) ABSTRACT

An inkjet printer includes a plurality of fixed printheads and a transfer roller. The transfer roller collects ink from the printheads and transfers the collected ink onto a print medium.

19 Claims, 3 Drawing Sheets

INKJET PRINTER INCLUDING FIXED PRINTHEADS AND TRANSFER ROLLER

REFERENCE TO CROSS-RELATED APPLICATION

This is a continuation-in-part of U.S. Ser. No. 09/571,647 filed May 15, 2000, now pending.

BACKGROUND OF THE INVENTION

The present invention relates to an inkjet printer including a plurality of fixed printheads. The present invention also relates to the printing of labels, receipts, bar code labels, tags, airline tickets and the like.

Inkjet printers are commonly used for printing receipts for point-of-sale transactions at supermarkets, retail stores and other businesses. A typical fixed printhead inkjet printer includes an array of printheads that are fixed relative to a print medium path. The printheads are staggered to achieve full printing width. For example, five printheads 10*a*–10*e* may be staggered as shown in FIG. 1. During printing, a print medium 12 is pulled off a supply roll and advanced in a forward direction along a flow axis. This forward direction is indicated by a first arrow F.

As the print medium 12 passes beneath the printheads 10*a*–10*e,* the printheads 10*a*–10*e* lay down swaths of ink dots on the print medium 12. After the printing has finished, the printed portion is advanced out of the printer and separated from the remainder of the print medium.

The print medium remaining in the printer has a large blank portion that begins at the first printhead 10*a* and terminates at a "leading edge" L. To avoid wasting print medium, the leading edge L is retraced back into the printer, near the first printhead 10*a* (the direction of retracing is indicated by a second arrow R). The retracing allows the printing of the next printout to begin near the leading edge L of the print medium 12.

When retracing the print medium, the leading edge should not be allowed to flap around. A vacuum hold down mechanism is typically used to control the leading edge as the print medium is being retraced. However, the vacuum hold down mechanism increases the complexity of the print medium path assembly.

Retracing the print medium also takes time, especially when the print medium is retraced over long distances. The retracing slows down the printing of labels, receipts, and the like.

Pulling the print medium back onto the supply roll during retracing can cause problems for the print medium back tensioning system of the printer. Edges of the print medium can also catch during retracing. Thus, the retracing can reduce handling reliability of the print medium.

SUMMARY OF THE INVENTION

According to one aspect of the present invention, a printer includes a plurality of fixed printheads; a print medium path; and a transfer roller for transferring ink from the printheads to a transfer zone on the print medium path. Other aspects and advantages of the present invention will become apparent from the following detailed description, taken in conjunction with the accompanying drawings, illustrating by way of example the principles of the present invention.

DETAILED DESCRIPTION OF THE INVENTION

Figure 1:
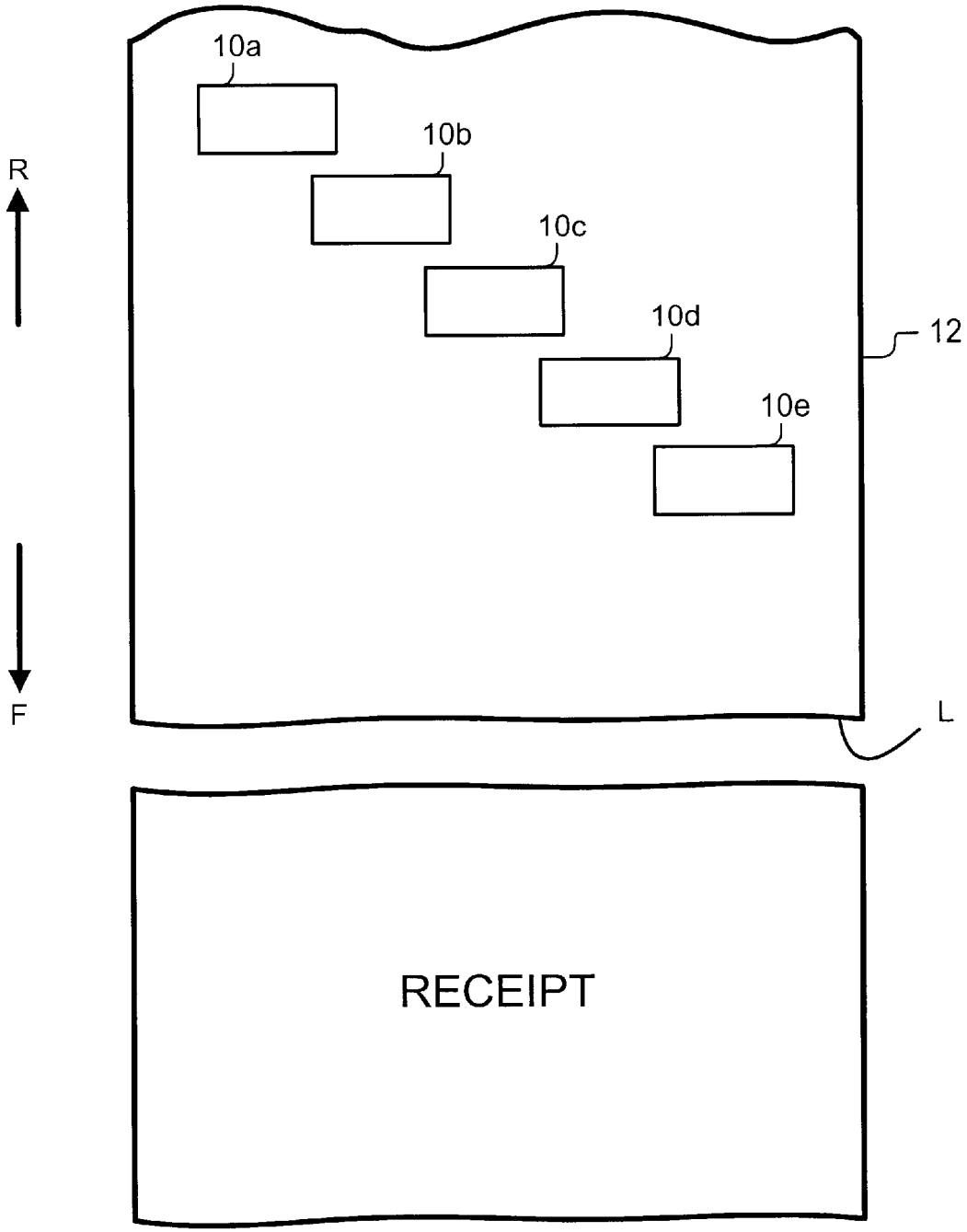
FIG. 1 (PRIOR ART)
FIG. 1 is an illustration of fixed printhead printing according to the prior art.

As shown in the drawings for purposes of illustration, the present invention is embodied in an inkjet printer for printing point-of-sale receipts. Printing the receipts requires little or no retracing. Consequently, receipts can be printed faster, with greater print medium handling reliability. Even if retracing is required, a vacuum hold down mechanism or other mechanism for controlling the leading edge of print medium is not required.

Figure 2:
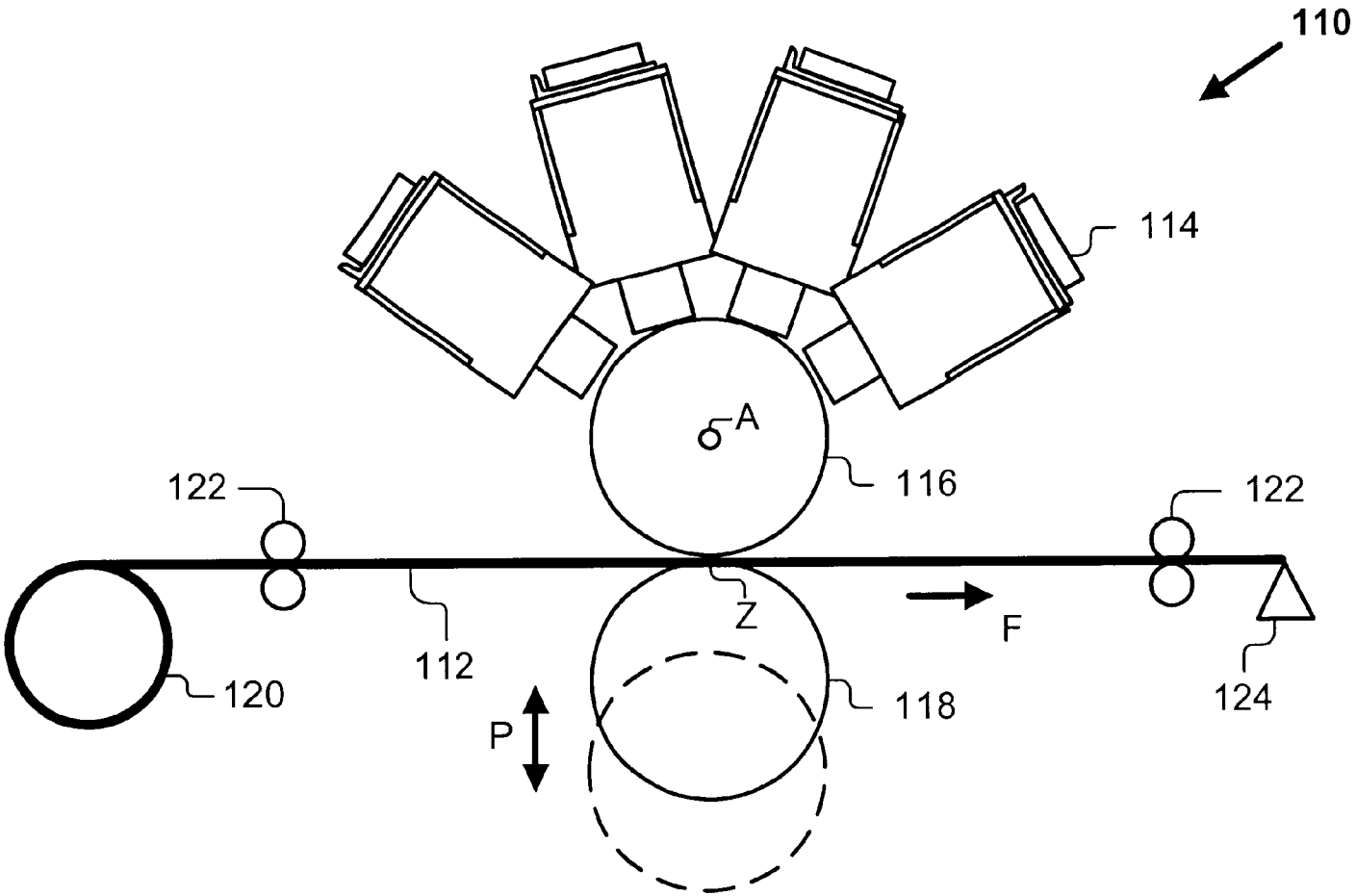
FIG. 2 is an illustration of an inkjet printer according to the present invention.

Reference is now made to FIG. 2, which shows an inkjet printer 110 for printing point-of-sale receipts. The printer 110 includes a print medium path 112, a plurality of printheads 114, a transfer roller 116, a pressure roller 118 and a print medium path assembly. The print medium path assembly includes a feed roller 120 for holding a supply roll of print medium, and pinch rollers 122 for pulling the print medium off the feed roller 120 and advancing the print medium in a flow direction past the printheads 114 (the flow direction is indicated by an arrow F).

The printheads 114 are disposed about the perimeter of the transfer roller 116 and they are stationary with respect to a rotational axis A of the transfer roller 116. The printheads 114 may be conventional inkjet printheads. Although four printheads 114 are shown, the printer 110 is not limited to such a number of printheads 114.

The pressure roller 118 is movable in a direction indicated by the double arrow P. An actuator such as a servo-driven cam-actuated mechanism moves the pressure roller 118 between a first position (shown in dashed) and a second position (shown in solid). In the first position, the pressure roller 118 is spaced apart, that is, disengaged from the transfer roller 116.

In the second position, the pressure roller 118 is urged against the transfer roller 116. A transfer zone Z or "nib" encompasses the contact surface between the transfer roller 116 and the pressure roller 118. The pressure roller 118 may have a resilient surface that is distorted during contact with the transfer roller 116. The distortion increases the area of the transfer zone Z.

The pressure roller 118 may be moved into engagement when printing begins, and moved out of engagement when printing ends.

Figure 3A:
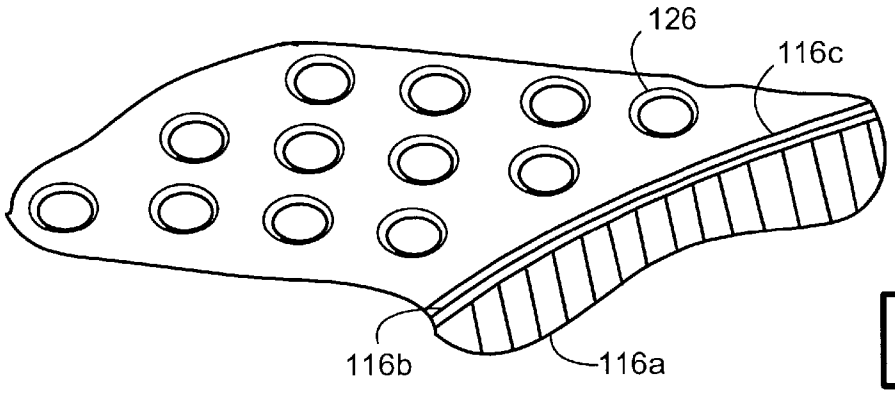
FIGS. 3*a* and 3*b* are illustrations of wells in a transfer roller, the transfer roller forming a part of the inkjet printer.

Referring additionally to FIG. 3*a,* the transfer roller 116 may include a cylindrical core 116*a* that is surrounded by a metal sheath 116*b*. A plurality of wells 126 are patterned in the sheath 116*b* and coated with a lining material 116*c* (also see FIG. 3*b*). The wells 126 are disposed about an outer surface of the transfer roller 116. During printing, the printheads 114 selectively fill the wells 126 with droplets of ink.

A receipt may be printed as follows. The pressure roller 118 is disengaged from the transfer roller 116, the transfer roller 116 is rotated at a constant angular velocity by a dc servo motor or other type of motor (not shown), and pinch rollers 122 pull the print medium off the feed roller 120 and advance the print medium in the flow direction.

The printheads 114 begin depositing droplets of ink into the wells 126. The printheads 114 may be fired in a conventional manner. For example, a controller (not shown) receives swath data from a host and commands the printheads 114 to fire (that is, deposit droplets of ink) in response to the swath data. As the transfer roller 116 is rotated, rows of wells 126 are filled with ink droplets.

The pressure roller 118 is then moved into the second position, where it is urged against the transfer roller 116, causing the transfer and pressure rollers 116 and 118 to be rolled forward. The print medium is pinched in between the two rollers 116 and 118.

As the transfer roller 116 continues to rotate, rows of wells 126 enter the transfer zone Z and come in contact with the print medium. Ink droplets in these rows of wells 122 are transferred onto the print medium. This all happens so quickly that the ink doesn't have time to dry on the transfer roller 116 before it is transferred to the print medium.

After text and images have been transferred to the print medium (that is, after the receipt has been printed), the pressure roller 118 is disengaged and the pinch rollers 122 advance the receipt past a cutting tool 124. The cutting tool 124 may be used to detach the receipt.

Since the transfer of ink to the print medium happens along a line in the transfer zone Z, the cutting tool 124 may be located very close to the transfer zone Z. Therefore, little or no retracing is required to prepare for the next printout.

A vacuum hold down mechanism is not needed to control the leading edge of the print medium. This simplifies the design of the print medium path assembly.

The printer 110 may have a small form factor in the direction the print medium travels because the printheads 114 are wrapped around the transfer roller 116. Contrast this to the spaced-apart printheads 10*a*–10*e* of FIG. 1.

Figure 3B:
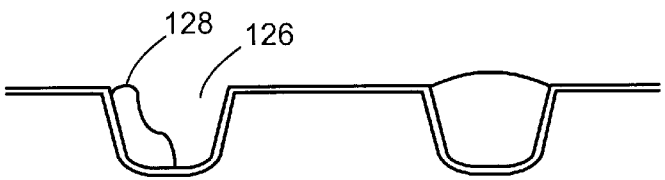

Referring now to FIG. 3*b,* exemplary dimensions of each well 126 include a width of about 200 micrometers and a depth of about 45 micrometers. These dimensions allow each well 126 to hold a few drops of ink 128. The wells 126 are spaced apart to achieve a desired print density (e.g., 600 dpi). Sidewalls of the wells 126 may be tapered to force the droplets 128 to collect at the bottom of the wells 126. Surface tension causes a meniscus of ink to form at the top of a well 126. During transfer, the droplets 128 snap cleanly out of the smooth-lined wells 126 and onto the print medium. Virtually no ink is left behind.

Figure 4:
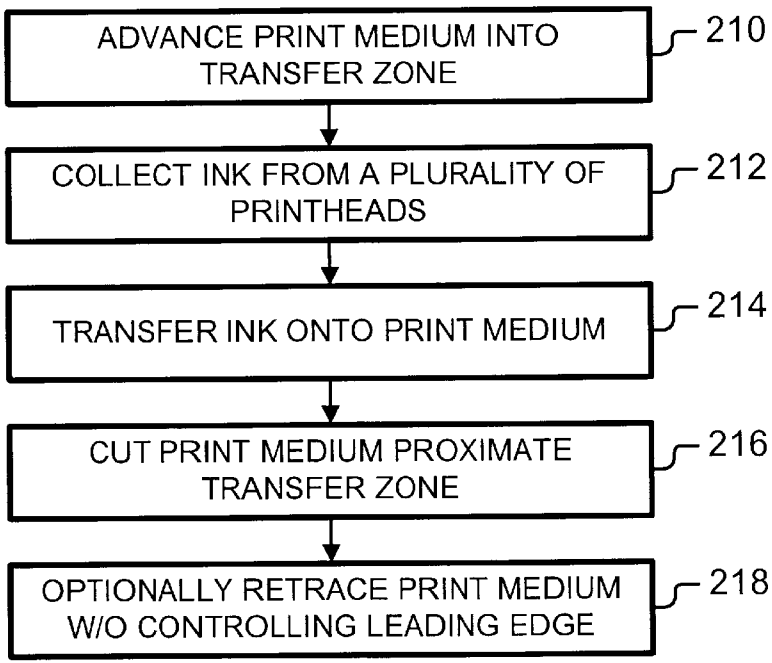
FIG. 4 is an illustration of a method of printing according to the present invention.

Reference is now made to FIG. 4, which summarizes a method of printing in accordance with the present invention. A print medium is advanced into a transfer zone (block 210), ink is collected from a plurality of fixed, staggered printheads (block 212), and the collected ink is transferred onto the print medium at the transfer zone (block 214). After text and images have been transferred onto the print medium, the printed portion is detached (block 216). After the printed portion has been detached, the print medium may be optionally retraced without controlling a leading edge of the print medium (block 218).

The wells are not limited to round cells. Other well configurations may be used. For example, the wells may be angularly-shaped. Other well (or cell) configurations are disclosed in U.S. Ser. No. 09/571,647, which is incorporated herein by reference.

The printheads do not have to fixed. For example, the printheads may move in the direction of the rotational the axis of the transfer roller.

Although the printer was described above in connection with printing point-of-sale receipts, it is not so limited. For instance, the printer may be used for printing labels, bar code labels, tags, airline tickets and the like. In general, the printer may be used to print on cut print media, continuous print media (e.g., print media on supply rolls), etc.

The printer includes motor drives and motor controllers, which are not shown in FIG. 2. The transfer roller, pressure roller and pinch rollers are all driven by servo. The mechanism for moving the pressure roller between the first and second positions may be implemented in any number of ways. For example, a motor/transmission might drive an actuator such as a cam or lever.

The printer also includes a back tensioning system for the print medium. The back tensioning system is not shown in FIG. 2.

The printer includes a print controller, which is not shown in FIG. 2. The print controller receives swath data from the host, and commands the printheads to fire, the motor controllers to drive the rollers, etc.

The present invention is not limited to the specific embodiments described above. Instead, the present invention is construed according to the claims that follow.

What is claimed is:

1. A printer comprising:

a plurality of printheads;

a print medium path; and a transfer roller having a surface patterned with a plurality of wells for collecting ink from the plurality of printheads and transferring the ink to a transfer zone on the print medium path.

2. The printer of claim 1, further comprising a pressure roller, the transfer zone being defined by the transfer roller and the pressure roller when the pressure roller is urged against the transfer roller.

3. The printer of claim 2, wherein the pressure roller is movable between a first position and a second position, the pressure roller being disengaged with the transfer roller when the pressure roller is in the first position, the pressure roller being urged against the transfer roller when the pressure roller is in the second position.

4. The printer of claim 1, further comprising print medium-advancing rollers on opposite sides of the transfer zone.

5. A printer comprising:

a plurality of printheads;

a print medium path;

a transfer roller for collecting ink from the plurality of printheads and transferring the ink to a transfer zone on the print medium path; and an assembly for performing retracing without print medium leading edge control.

6. The printer of claim 5, further comprising a cutting tool proximate the transfer zone.

7. The printer of claim 1, further comprising a feed roller for accommodating a supply roll.

8. A printer comprising:

a transfer roller;

a plurality of fixed printheads surrounding the transfer roller; and a pressure roller movable against the transfer roller, the transfer roller and the pressure roller defining a transfer nib when the pressure roller is urged against the transfer roller wherein an outer surface of the pressure roller is deformable.

9. The printer of claim 8, wherein the pressure roller is movable between a first position and a second position, the pressure roller being disengaged with the transfer roller when the pressure roller is in the first position, the pressure roller being engaged with the transfer roller when the pressure roller is in the second position.

10. The printer of claim 8, further comprising pinch rollers on opposite sides of the transfer nib.

11. The printer of claim 8, further comprising means for retracing a leading edge of a print medium to a position proximate the transfer nib without controlling the leading edge.

12. The printer of claim 8, further comprising a cutting tool proximate the transfer nib.

13. A printer comprising:

a plurality of fixed printheads;

a paper path having a transfer zone:

first means for collecting ink from the printheads and transferring the collected ink to a portion of a print medium within the transfer zone;

second means for urging the portion of the print medium against the first means during transfer of the ink; and means for retracing a print medium leading edge to a position proximate the transfer zone without controlling the leading edge.

14. A method of using a plurality of printheads to print on a print medium, the method comprising:

advancing the print medium into a print zone;

collecting ink from the printheads without making a print; and making a print on the print medium by transferring the collected ink onto the print medium at a transfer zone within the print zone while applying pressure to the print medium at the transfer zone.

15. The method of claim 14, wherein a transfer roller is used to collect and transfer the ink; and wherein the pressure is applied by urging a portion of the print medium within the transfer zone against the transfer roller while the ink is being transferred.

16. The method of claim 15, further comprising stopping the urging after the ink has been transferred.

17. The method of claim 14, further comprising detaching the print medium near the transfer zone.

18. The method of claim 14, wherein the print medium is advanced by contacting the print medium at points proximate the transfer zone.

19. The method of claim 14, further comprising retracing the print medium without controlling a leading edge of the print medium.

* * * * *